US010256025B2

(12) United States Patent
Ma et al.

(10) Patent No.: US 10,256,025 B2
(45) Date of Patent: Apr. 9, 2019

(54) STEP GAP INDUCTOR APPARATUS AND METHODS

(71) Applicant: Pulse Electronics, Inc., San Diego, CA (US)

(72) Inventors: Hongzhong Ma, Zhuhai (CN); Shuhui Chen, Hengnan County (CN)

(73) Assignee: PULSE ELECTRONICS, INC., San Diego, CA (US)

( * ) Notice: Subject to any disclaimer, the term of this patent is extended or adjusted under 35 U.S.C. 154(b) by 293 days.

(21) Appl. No.: 15/204,713

(22) Filed: Jul. 7, 2016

(65) Prior Publication Data

US 2017/0011836 A1 Jan. 12, 2017

Related U.S. Application Data

(60) Provisional application No. 62/191,138, filed on Jul. 10, 2015.

(51) Int. Cl.

| | |
|---|---|
| ***H01F 27/24*** | (2006.01) |
| ***H01F 27/30*** | (2006.01) |
| ***H01F 17/06*** | (2006.01) |
| ***H01F 17/04*** | (2006.01) |
| ***H01F 27/255*** | (2006.01) |
| ***H01F 27/29*** | (2006.01) |

(52) U.S. Cl.

CPC ..... *H01F 27/255* (2013.01); *H01F 27/292* (2013.01); *H01F 27/306* (2013.01); *H01F 2017/048* (2013.01)

(58) Field of Classification Search

USPC ..... 336/212

See application file for complete search history.

(56) References Cited

U.S. PATENT DOCUMENTS

| | | | |
|---|---|---|---|
| 3,931,566 | A | 1/1976 | Pask et al. |
| 4,714,808 | A | 12/1987 | Brolin |
| 4,978,829 | A | 12/1990 | Gurwicz |
| 5,146,198 | A | 9/1992 | Pollard et al. |
| 5,399,825 | A | 3/1995 | Valenzuela |
| 5,475,297 | A | 12/1995 | Kaneko |

(Continued)

FOREIGN PATENT DOCUMENTS

| | | | |
|---|---|---|---|
| CN | 102543370 | A | 7/2012 |
| CN | 103680861 | A | 3/2014 |
| CN | 203966761 | U | 11/2014 |

*Primary Examiner* — Ronald Hinson

(74) *Attorney, Agent, or Firm* — Gazdzinski & Associates, PC

(57) ABSTRACT

A low cost, low profile, small size and high performance inductive device for use in electronic circuits. In one exemplary embodiment, the device includes a ferrite core comprising a step gap, a winding disposed on the core, and a magnetic powder and epoxy mixture packed in to create a cubic-shaped inductor optimized for electrical and magnetic performance. Additionally, the incorporation of the magnetic powder and epoxy mixture around the step gap eliminates fringing magnetic fields during device operation thereby minimizing adverse electromagnetic inference on adjacently disposed electronic components. The geometry and placement of the step gaps can be varied in order to optimize performance parameters associated with the underlying inductive device. Methods of manufacture and use for the inductive device are also disclosed.

18 Claims, 7 Drawing Sheets

(56) References Cited

U.S. PATENT DOCUMENTS

| | | | | |
|---|---|---|---|---|
| 5,991,169 | A | 11/1999 | Kooken | |
| 6,501,362 | B1 * | 12/2002 | Hoffman | H01F 17/043 336/192 |
| 6,639,781 | B2 | 10/2003 | Smith et al. | |
| 6,774,758 | B2 | 8/2004 | Gokhale et al. | |
| 6,922,883 | B2 | 8/2005 | Gokhale et al. | |
| 6,958,666 | B2 | 10/2005 | Begon et al. | |
| 6,965,290 | B2 | 11/2005 | Gokhale et al. | |
| 7,489,219 | B2 | 2/2009 | Satardja et al. | |
| 7,535,187 | B2 | 5/2009 | Carstensen | |
| 7,849,586 | B2 | 12/2010 | Sutardja et al. | |
| 7,915,993 | B2 * | 3/2011 | Liu | H01F 17/04 336/200 |
| 8,032,082 | B2 | 10/2011 | Boguslavskij et al. | |
| 8,089,333 | B2 | 1/2012 | Maclennan et al. | |
| 8,102,233 | B2 | 1/2012 | Ikriannikov | |
| 8,203,411 | B2 | 6/2012 | MacLennan | |
| 8,279,037 | B2 | 10/2012 | Yan et al. | |
| 8,294,544 | B2 | 10/2012 | Ikriannikov et al. | |
| 8,299,885 | B2 * | 10/2012 | Ikriannikov | H01F 17/0006 336/212 |
| 8,354,624 | B2 | 1/2013 | Schildt | |
| 8,624,702 | B2 | 1/2014 | MacLennan et al. | |
| 2005/0012583 | A1 | 1/2005 | Sutardja et al. | |
| 2006/0114091 | A1 | 6/2006 | Sutardja et al. | |
| 2006/0114093 | A1 * | 6/2006 | Sutardja | H01F 3/10 336/178 |
| 2007/0139153 | A1 * | 6/2007 | Lai | H01F 17/045 336/212 |
| 2010/0214050 | A1 | 8/2010 | Opina, Jr. et al. | |
| 2012/0056704 | A1 * | 3/2012 | Nagano | H01F 27/38 336/170 |

* cited by examiner

STEP GAP INDUCTOR APPARATUS AND METHODS

PRIORITY

This application claims priority to co-owned U.S. Provisional Patent Application Ser. No. 62/191,138 filed Jul. 10, 2015 of the same title, which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

1. Technological Field

The present disclosure relates generally to inductive circuit elements, and more particularly to inductive devices having various desirable electrical and/or mechanical properties, and methods of operating and manufacturing the same.

2. Description of Related Technology

Myriad different configurations of inductors and inductive devices are known in the prior art. For example, U.S. Pat. No. 6,922,883 to Gokhale et al. discloses non-linear inductors that are used to reduce the percent total harmonic distortion of the harmonics in the line currents on the input side of a rectifier system of an alternating current (AC) drive system. U.S. Pat. No. 7,489,219 to Satardja discloses a power inductor having a first magnetic core made from a ferrite bead core material. The first magnetic core includes an inner cavity that extends from a first end to a second end of the core as well as a slotted air gap that also extends from the first end to the second end. A conductor passes through this cavity. The power inductor also includes a second magnetic core located in and adjacent to the air gap having a permeability that is lower than the first magnetic core. U.S. Pat. No. 7,915,993 to Liu et al. discloses an inductor that includes a first core, a second core, a protruding structure, a conducting wire and at least two gaps. The aforementioned U.S. patents represent various approaches to providing varying inductance values within a circuit.

Despite the foregoing variety of prior art inductor configurations, there is a distinct lack of a small, highly customizable, low-cost, high-performance inductor configuration that provides an inductance value that varies depending on the amount of current flowing through it. Specifically, it is desirable to provide an inductive device that provides a high level of inductance at lower currents, while quickly dropping (i.e., rapidly rolling off) the level of inductance for the inductive device at higher currents without achieving core saturation. Moreover, such inductive devices would ideally limit fringe magnetic field lines generated during device operation, so as to, inter alia, limit electromagnetic interference (EMI) from affecting adjacently disposed electronic components. Moreover, obtaining these desirable performance parameters in small sized inductive devices is highly desirable in end device applications where space is limited.

Hence, there is a need for an improved inductive device that is constructed to substantially improve inductive performance flexibility, reduce or eliminate the deleterious effect of fringe magnetic fields, and maintain a reduced size/footprint over prior art inductive devices.

SUMMARY

The present disclosure satisfies the foregoing by providing an improved inductive device (and assemblies comprising one or more of the devices), as well as methods of manufacturing and utilizing the same.

In a first aspect, an inductive device is provided. In one embodiment, the inductive device includes a core base element having two side core elements; and a center core element having a step gap formed therein, the center core element disposed between the two side core elements. Relative sizes for the center core element and the two side core elements are selected so as to form a cavity between the two side core elements. The inductive device further includes a winding disposed at least partially within the cavity; and a mixture of magnetic powder and epoxy disposed within the cavity.

In a second aspect, methods of manufacturing the aforementioned inductive device are disclosed. In one embodiment, the method includes obtaining one or more core pieces, the one or more core pieces comprising two side core elements and a central core element disposed between the two side core elements, the one or more core pieces further comprising a cavity disposed between the two side core elements; forming a step gap within the central core element; inserting a lead within the cavity; and inserting an epoxy mixture within the cavity.

In a third aspect, methods of using the aforementioned inductive device are disclosed. In one embodiment, the method includes utilizing the inductive device so as to minimize the amount of time spent in high-dissipation transition states between so-called "full-on" and "full-off" states.

In a fourth aspect, systems that incorporate the aforementioned inductive device are disclosed. In one embodiment, the system comprises a switched-mode power supply for use in portable electronics apparatus, such as for instance a laptop computer.

In a fifth aspect, a portable electronics apparatus is disclosed. In one embodiment, the portable electronics apparatus includes a switched mode power supply, the switched mode power supply including an inductive device having a step gap formed therein. The inductive device with the step gap formed therein is configured to increase an initial inductance value for the inductive device at lower current values as compared with an inductance value for the inductive device at a higher operational current.

In a sixth aspect, a method of reducing power consumption in an electronic device is disclosed. In one embodiment, the method includes utilizing the aforementioned inductive device.

In a seventh aspect, an inductive apparatus with mitigated EMI signature is disclosed. In one embodiment, the inductive apparatus includes a step gap, the step gap being substantially encapsulated with an epoxy mixture so as to contain fringing magnetic fields during inductive apparatus operation.

In an eighth aspect, a method of mitigating an EMI signature associated with an inductive device is disclosed. In one embodiment, the method includes inserting a step gap within a U-shaped cavity of a unitary magnetically permeable core; disposing a winding within the U-shaped cavity; and filling the U-shaped cavity with the winding disposed therein with a mixture of epoxy and magnetic powder.

BRIEF DESCRIPTION OF THE DRAWINGS

The features, objectives, and advantages of the disclosure will become more apparent from the detailed description set forth below when taken in conjunction with the drawings, wherein.

DETAILED DESCRIPTION

Figure 1:
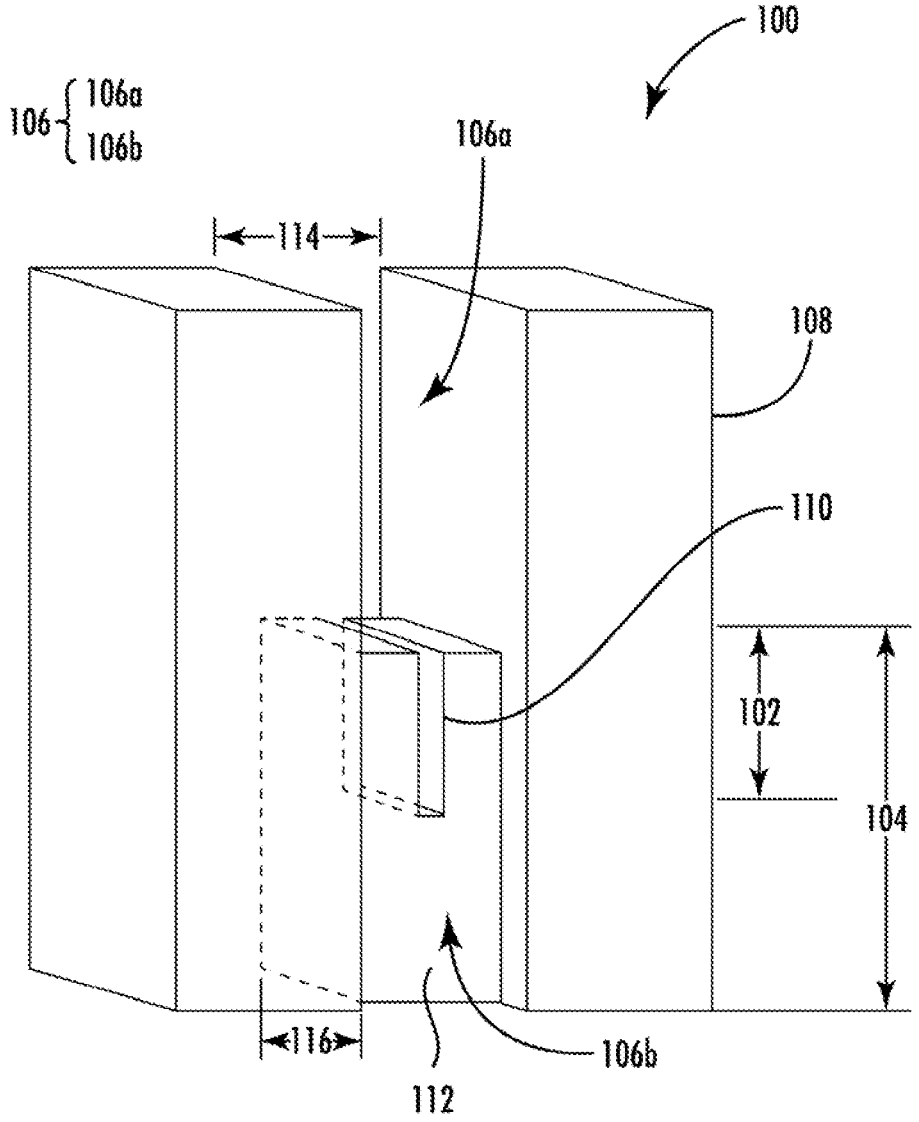
FIG. 1 is a perspective view of one exemplary embodiment of a core element in accordance with the principles of the present disclosure.

Reference is now made to the drawings wherein like numerals refer to like parts throughout.

As used herein, the term "electronic component" is used to refer to components adapted to provide some electrical function, including without limitation inductive reactors ("choke coils"), transformers, filters, gapped, core toroids, inductors, capacitors, resistors, operational amplifiers, and diodes, whether discrete components or integrated circuits, whether alone or in combination. For example, the improved toroidal device disclosed in Assignee's U.S. Pat. No. 6,642,827 entitled "Advanced Electronic Microminiature Coil and Method of Manufacturing" filed Sep. 13, 2000, which is incorporated herein by reference in its entirety, may be used in conjunction with embodiments of the disclosure contained herein.

As used herein, the term "magnetically permeable" refers to any number of materials commonly used for forming inductive cores or similar components, including without limitation various formulations made from ferrite.

As used herein, the term "signal conditioning" or "conditioning" shall be understood to include, but not be limited to, signal voltage transformation, filtering, current limiting, sampling, processing, and time delay.

As used herein, the term "winding" refers to any type of conductor(s), irrespective of shape, cross-section, material, or number of turns, which is/are adapted to carry electrical current.

Overview

The present disclosure provides, inter alia, improved inductive apparatus and methods for manufacturing and utilizing the same.

In one embodiment, the inductive device of the present disclosure includes a core element, a self-leaded winding, and an epoxy mixture. The core element has a step gap formed therein, and defines a U-shaped cavity. The epoxy mixture comprises, in an exemplary embodiment, a magnetic powder and epoxy mixture that is formed within the U-shaped cavity that, in combination with the self-leaded winding, substantially fills the cavity, thereby resulting in a rectangular-shaped inductive device. Such a configuration includes surrounding the step gap with magnetic material, thereby forming a closed magnetic path, and eliminating or substantially mitigating undesirable fringe magnetic flux fields from emanating from the inductive device. Moreover, such exemplary inductive apparatus minimizes the amount of time spent in high-dissipation transition states between so-called "full-on" and "full-off" (thereby minimizing the amount of wasted energy).

Methods of manufacturing and using the aforementioned inductive devices are also disclosed.

Exemplary Apparatus—

It will be recognized that while the following discussion is cast primarily in terms of inductive devices for use with e.g., switched-mode power supplies, and specifically in applications that minimize the amount of time spent in high-dissipation transition states between so-called "full-on" and "full-off" (thereby minimizing the amount of wasted energy), the principles of the present disclosure are not so limited. In fact, the principles of the present disclosure are useful in any number of end applications that can benefit from the step gap configurations and core geometries described herein such as, for example and without limitation, other power supply applications including: direct current (DC) power supplies; alternating current (AC) power supplies; programmable power supplies; uninterruptible power supplies; and high voltage power supplies.

Referring now to FIG. 1, a magnetically permeable core element 100 (made from, for example, a ferrite-based material) having a step gap 110 in accordance with the principles of the present disclosure is shown. In the illustrated embodiment, core element 100 includes generally rectangular side elements 108 as well as a rectangular center core element 112. The rectangular center core element 112 is, in the illustrated embodiment, smaller in height 104, width 114 and thickness 116 than the adjacently disposed rectangular side elements 108, thereby forming a U-shaped cavity 106 that is disposed between the two rectangular side elements 108. The U-shaped cavity 106 is, in an exemplary embodiment, sized to accommodate other portions of the inductive device (200, FIGS. 2A-2C) as will be described in additional detail subsequently herein. While a specific configuration is shown in FIG. 1, it is appreciated that the relative size of the center core element 112 with respect to the side elements 108 may be readily varied, as would be appreciated by one of ordinary skill given the present disclosure. For example, the height 104 of the center core element 112 can be increased or decreased, thereby decreasing or increasing the effective volume consumed by the top portion 106*a* of the U-shaped cavity 106, respectively. Moreover, the thickness 116 of the center core element 112 can also be increased or decreased, thereby decreasing or increasing the effective volume consumed by the side portions 106*b* of the U-shaped cavity 106, respectively. Yet further, it will be appreciated that the use of rectangular or "right angle" components is merely exemplary; it is contemplated that other shapes (e.g., trapezoidal, non-right angle, etc.) for the side and/or center core elements can be employed.

In the illustrated embodiment of FIG. 1, the introduction of a step gap 110 can be readily accomplished mechanically (e.g., such as by use of a dicing saw of the type commonly used in the manufacture of semiconductor wafers), or by being included at time of formation of the component. The depth 102 of the step gap 110 can be readily varied according to desired electrical performance characteristics as would be readily understood by one of ordinary skill given the present disclosure. While illustrated in FIG. 1 as a step gap having a rectangular volume, other step gap variations will be discussed subsequently herein with respect to FIGS. 4A-4E. Other step gap variants are also envisioned, including the introduction of one or more step gaps into the side elements 108 (not shown). However, such variants may have disadvantages associated therewith including: (1) difficulty in manufacture for single-piece construction core 100 embodiments; and (2) fringe effects resultant from the step gap being resident on the external surface of the side element(s) 108 (and core element 100).

In the illustrated embodiment, the core element 100 is manufactured as a unitary piece that is created either: (1) out of a mold with the center core element 112 and side elements 108 being pre-formed; or (2) out of a single rectangular block that is subsequently machined in order to form the overall dimensions of the side elements 108 and/or center core element 112. While primarily envisioned as being constructed as a single-piece core, it is appreciated that core element 100 may be constructed using two or more discrete pieces that are subsequently joined together using, for example, an epoxy or other adhesive of the type commonly known in the magnetically permeable material arts. Moreover, while such a multi-core construction results in mold(s) that are generally simpler to make, such a multi-core construction introduces additional manufacturing steps and gaps into the core element manufacturing process, thereby potentially introducing undesirable and/or inconsistent performance characteristics for the underlying core element 100.

Figure 2A:
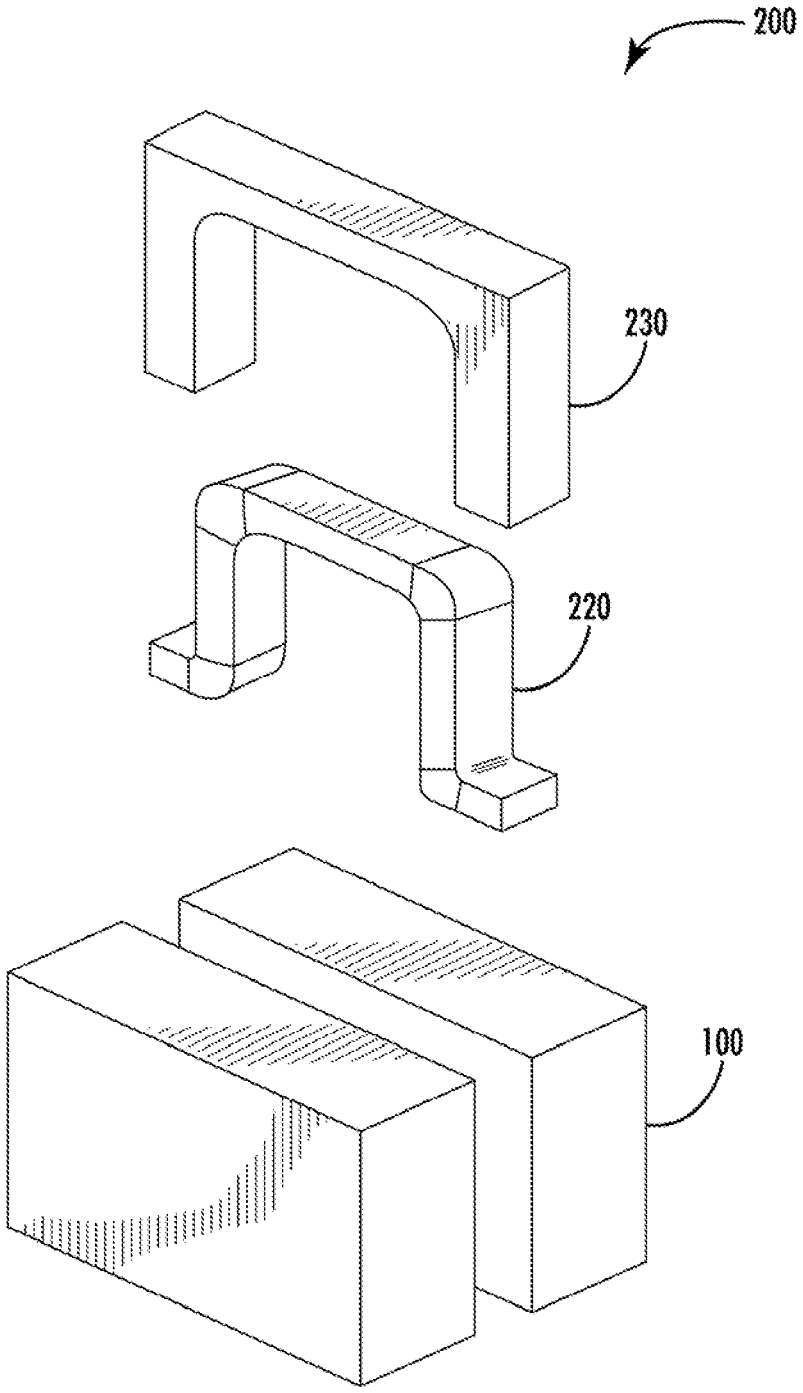
FIG. 2A is an exploded view of one exemplary embodiment of an inductive device that utilizes the core element of FIG. 1 in accordance with the principles of the present disclosure.
Figure 2B:
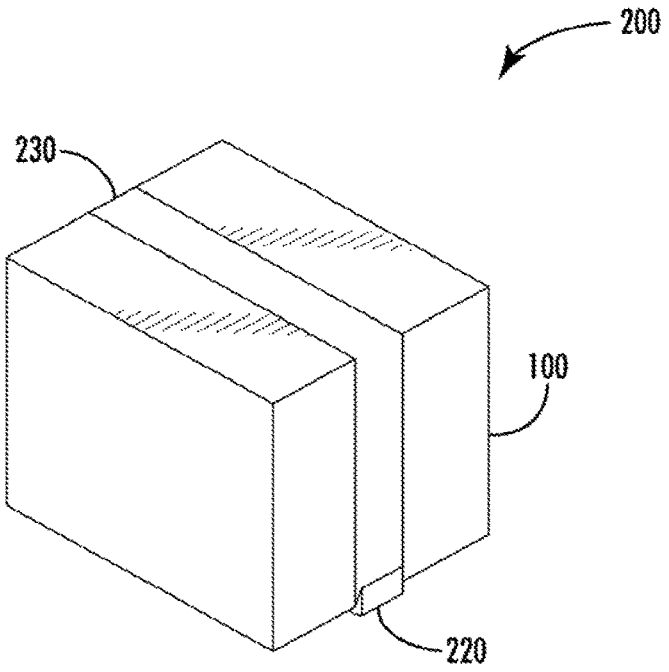
FIG. 2B is a perspective view illustrating the top of the assembled inductive device of FIG. 2A in accordance with the principles of the present disclosure.
Figure 2C:
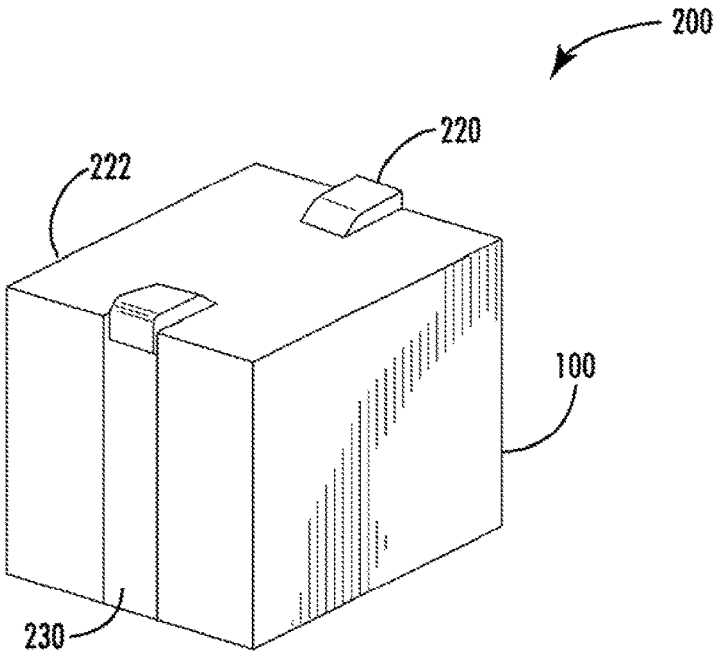
FIG. 2C is a perspective view illustrating the bottom of the assembled inductive device of FIG. 2A in accordance with the principles of the present disclosure.

Referring now to FIGS. 2A-2C, an inductive device 200 utilizing the core element 100 illustrated in FIG. 1 is shown and described in detail. The illustrated inductive device 200 includes a core element 100, a self-leaded winding 220, and an epoxy mixture 230. The epoxy mixture 230 comprises, in an exemplary embodiment, a magnetic powder (e.g., iron powder) and epoxy mixture that is formed within the U-shaped cavity 106, that in combination with the self-leaded winding 220, substantially fills the cavity 106 resulting in a rectangular-shaped inductive device, as shown in FIGS. 2B and 2C. The ratio of magnetic powder to epoxy can be adjusted so as to meet the desired electrical parameters (e.g., inductance), and optionally mechanical properties, for the underlying inductive device. Herein lies a salient advantage of the inductive device 200 of the present disclosure. Specifically, as is well known, gaps within a magnetic flux path result in fringing fields that can present electromagnetic interference issues for adjacently placed electronic components. As the step gap 110 residing within the core element 100 is substantially covered by the magnetic epoxy mixture (as shown in FIGS. 2B and 2C), the resultant magnetic field from current passing through the self-leaded winding 220 is substantially or even fully contained within the inductive device 200 structure, thereby minimizing potential deleterious electromagnetic interference for adjacently disposed electronic components.

The ratio of magnetic powder to epoxy (and/or use of other constituent materials such as doping agents) can be adjusted in the epoxy mixture 230 in order to meet the desired signal conditioning properties of the inductive device 200. In an exemplary embodiment, this ratio is adjusted such that a relatively high inductance value is achieved under light loading (i.e., low current values). The relative permeability $\mu/\mu_0$ for the epoxy mixture 230 is, in an exemplary embodiment, relatively low (i.e., in the approximate range of 60-200). The relative permeability for air is $\mu_0=1$, while the permeability for the core element 100 is typically in the range of 2000-5000 for various ferrite-based materials. However, it is appreciated that these permeability values may be varied in order to meet the desired inductive characteristics for the inductive device 200. See also the discussion of inductance as a function of direct current (DC) bias in FIG. 3 infra.

The self-leaded winding 220 in one embodiment includes a single turn winding with incorporated gull-wing shaped leads 222. The leads 222 are configured to couple the inductive device to an external substrate (e.g., printed circuit board) for the end device application (e.g., a switched-mode power supply). This coupling can be achieved in any number of ways including standard solder-reflow processes or even hand soldering. The gull-wing shaped leads 222 may be obviated in favor of through-hole leads (or yet other types of interfaces) in alternative embodiments, thereby enabling the coupling of the inductive device to the substrate via wave soldering (and even hand soldering). Moreover, while a single turn winding is illustrated, it is appreciated that multiple turn embodiments are also envisioned in which the winding 220 can be readily formed so as to encircle the center core element 112 two or more times.

The incorporation of the step gap 110 into the core element 100 of the inductive device 200 (as compared with for example traditional bead inductors) results in a "softer" saturation character for the device, and a high inductance value at low DC bias currents. These features improve the efficiency of the inductive device 200 resulting in lower power loss, which is desirable in end-applications such as portable device computing devices (e.g., laptops, tablets, etc.) where power consumption and battery life are primary concerns. In addition, the incorporation of the step gap 110 also increases the amount of current that can be run through the inductive device 200 before the core element 100 and epoxy mixture 230 saturate, as compared with traditional prior art (e.g., bead) inductors.

Inductive Device Performance—

Figure 3:
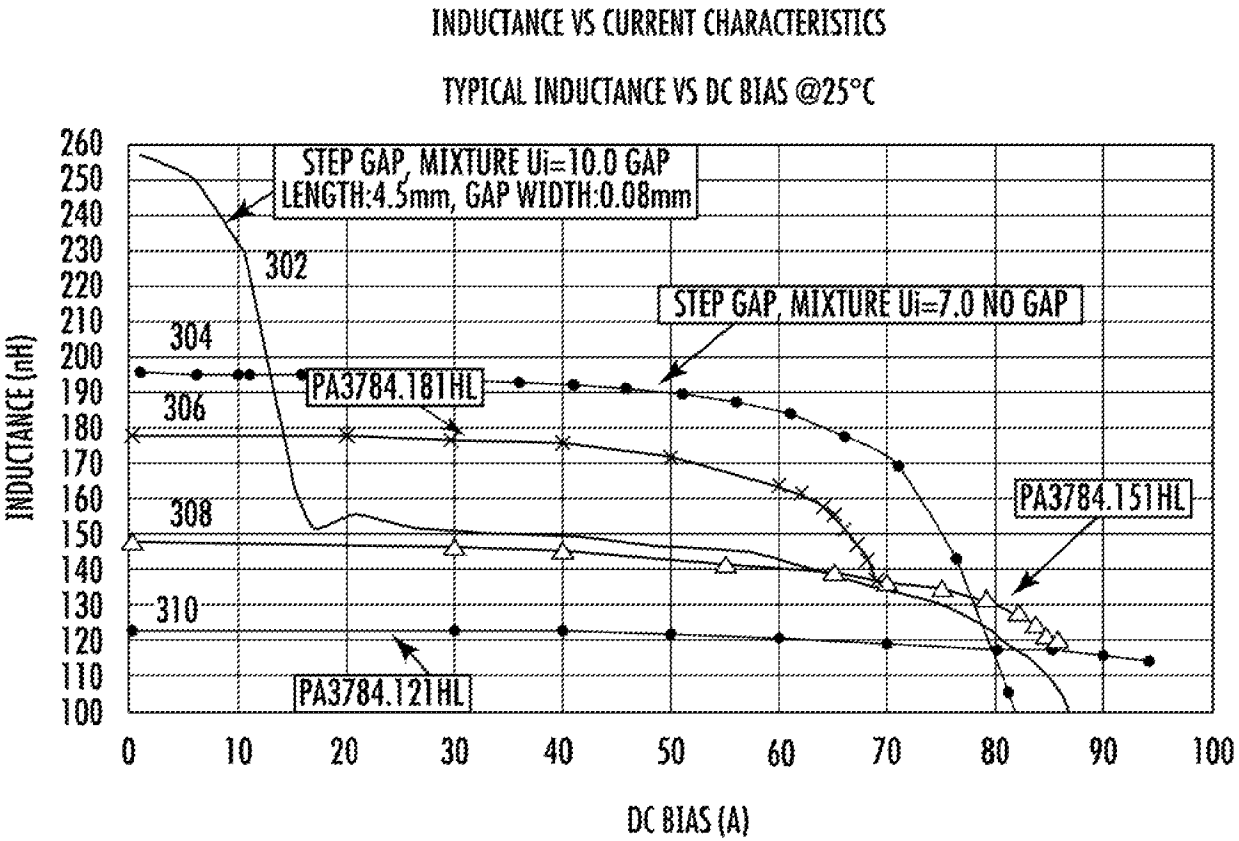
FIG. 3 is a graph illustrating typical inductance values as a function of current comparing the performance of the inductive device of FIGS. 2A-2C with the performance of other prior art inductive devices in accordance with the principles of the present disclosure.

Referring now to FIG. 3, a graph of inductance as a function of current at a temperature of 25° C. is shown and described in detail. They Y-axis illustrate inductance values that range between 100 nH and 260 nH, while the X-axis illustrates DC bias values ranging from 0 A up to 100 A. The solid line 302 illustrates the performance of the exemplary inductive device 200 as shown in FIGS. 2A-2C having a step gap 110 with a gap length (depth) of 4.5 mm and a gap width of 0.08 mm. The epoxy mixture 230 has, in the illustrated embodiment, a permeability value of 10.0. As can be seen in FIG. 3, line 302 illustrates that the initial inductance value of the inductive device at low currents is approximately 260 nH which drops down to an inductance value of approximately 155 nH at a current of approximately 17 A. The inductance value is maintained at a range of approximately 155 nH to 100 nH up to approximately 87 A when the inductive device 200 starts to saturate. Line 304 illustrates the performance of an inductive device (similar to that shown in FIGS. 2A-2C) without a step gap and having an epoxy mixture 230 with a permeability value of 7.0. As can be seen in FIG. 3, line 304 illustrates a much lower initial inductance value for the inductive device of approximately 200 nH. The inductance value is maintained at a range of approximately 200 nH to 170 nH up to approximately 70 A when the inductive device starts to saturate. Line 304 illustrates an inductance value of approximately 100 nH at approximately 81 A. Lines 306, 308 and 310 illustrate the inductance values as a function of current for various typical prior art bead inductors (i.e., the PA3784.XXXHL series of power inductors manufactured by the Assignee hereof). As can be seen, these prior art bead inductors are manufactured with lower initial inductance values (as compared with lines 302 and 304); however, manufacturing these prior art bead inductors with these lower initial inductance values correlates with lower saturation currents for these inductive devices. For example, line 306 (corresponding to PA3784.181HL) has an initial inductance value of approximately 180 nH that becomes saturated at a current of approximately 67 A; line 308 (corresponding to PA3784.151HL) has an initial inductance value of approximately 150 nH that becomes saturated at a current of approximately 83 A; and line 310 (corresponding to PA3784.121HL) has an initial inductance value of approximately 120 nH that becomes saturated at a current of approximately 94 A.

Step Gap Variations—

The step gap 110 incorporated into the core element 100 can be implemented in any number of differing manners. For example, and as previously discussed with respect to FIG. 1, the step gap can have consistent depth (i.e., the depth does not vary as a function of core element length) of 4.5 mm with a gap width of 0.08 mm. Such a step gap 110 is utilized with a core element 100 having an overall length of 9.8 mm; an overall width of 7.8 mm; and an overall height of 7.8 mm. The step gap functions as an area where the magnetic permeability in the magnetic flux path of the inductive device deviates from the surrounding material (here the remaining portion of the core element 100 and the epoxy mixture 230 portion). In the present instance, where the step gap 110 is essentially an air gap with a magnetic permeability of 1, when the portion of the core element 100 beneath the step gap 110 starts to become saturated (and/or where the epoxy mixture portion 230 begins to saturate), the area where the step gap 110 is located remains unsaturated, and the core element 100 behaves accordingly. Accordingly, the amount of DC bias the inductive device 200 can accommodate prior to saturation also increases. In this manner, the inductive device 200 illustrated in FIGS. 2A-2C functions according to the inductance as a function of DC bias as illustrated in FIG. 3 at line 302. Moreover, it is appreciated that varying the size and shape of this step gap 104 feature can be used to selectively alter the saturation and inductance characteristics for the underlying inductive device.

Figure 4C:
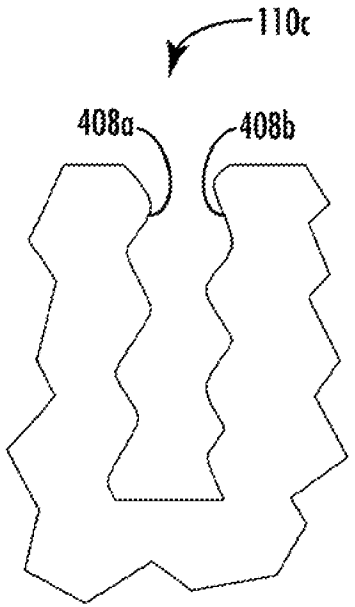
FIG. 4C is a front view of a third exemplary step gap configuration useful in, for example, the inductive device illustrated in FIGS. 2A-2C.
Figure 4B:
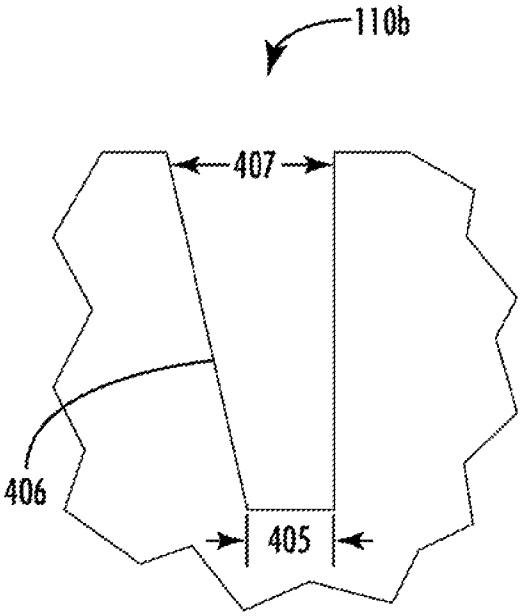
FIG. 4B is a front view of a second exemplary step gap configuration useful in, for example, the inductive device illustrated in FIGS. 2A-2C.
Figure 4A:
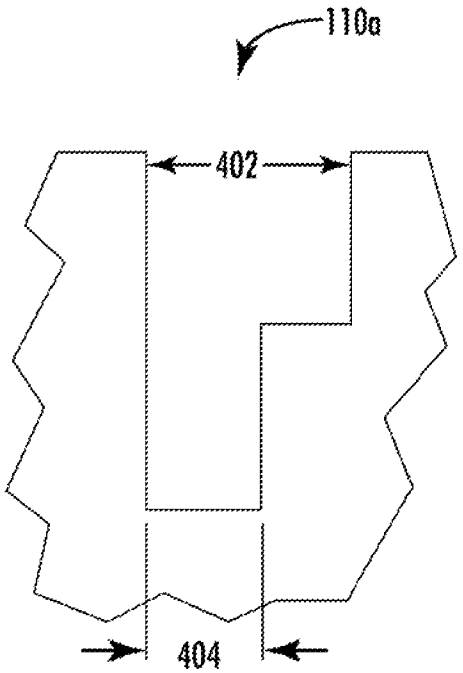
FIG. 4A is a front view of a first exemplary step gap configuration useful in, for example, the inductive device illustrated in FIGS. 2A-2C.

Referring to FIG. 4A, here the step gap 110*a* is further divided into a stepped configuration, where the first portion of the step gap 110*a* functions as a gap having a first width 402 while the second portion functions as a gap having a second, different width 404. Essentially, as the second portion having the second width 404 begins to saturate (i.e., due to increasing magnetic flux through this portion), the first portion having the first width 402 remains unsaturated, and behaves as such. FIG. 4B illustrates a variant of this stepped configuration for step gap 110*b* having an angled wall 406 that varies from a first width 407 to a second width 405 along the depth dimension. Here, as the portion along the angled wall 406 closer to the second width 405 begins to saturate, the portion closer to the first width 407 will remain unsaturated resulting in, inter alia, an inductive device 200 that can handle higher saturation currents as compared with a rectangular step gap 110 having a gap of constant width 405.

While the walls illustrated in FIGS. 4A and 4B are relatively smooth, the relative coarseness of the surfaces of the step gap can also be varied as shown in FIG. 4C. Here, the step gap 110*c* walls 408*a*, 408*b* can have varying levels of coarseness resulting in so-called "micro-gaps" or "residue gaps". By varying the surface parameters (e.g., coarseness or granularity) of the core material chosen and/or by using various degrees of polishing on the walls of step gap 110*c*, the inductive properties of the step gap can also be controlled. The use of "residue gaps" to provide, for example, precise control of the properties of the underlying inductive device is described in co-owned U.S. Pat. No. 7,567,163 entitled "Precision inductive devices and methods" filed on Aug. 26, 2005, the contents of which is incorporated herein by reference in its entirety.

Figure 4D:
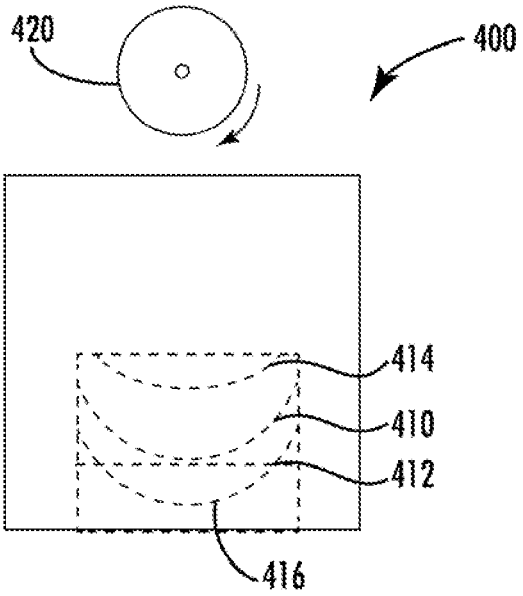
FIG. 4D is a side view illustrating fourth exemplary step gap configurations useful in, for example, the inductive device illustrated in FIGS. 2A-2C.

Referring now to FIG. 4D, a side view of exemplary step gaps 400 as created by an exemplary process such as via a dicing saw 420 is shown and described in detail. Specifically, line 412 illustrates a step gap (such as step gap 110) in which the exemplary dicing saw traverses throughout the thickness of the core. However, in embodiments such as that shown with respect to line 414, the circular dicing saw is plunged into, for example, the center portion 112 of core 100 resulting in a geometry for the step gap as shown. In other words, an air gap remains in the portion above line 414, while the portion underneath line 414 has a magnetic permeability equal to underlying core material. Variations in dicing saw plunge depth as shown by lines 410, 416 result in air gaps having varying surface area with the areas underneath lines 410 or 416 having a magnetic permeability equal to the underlying core material.

Figure 4E:
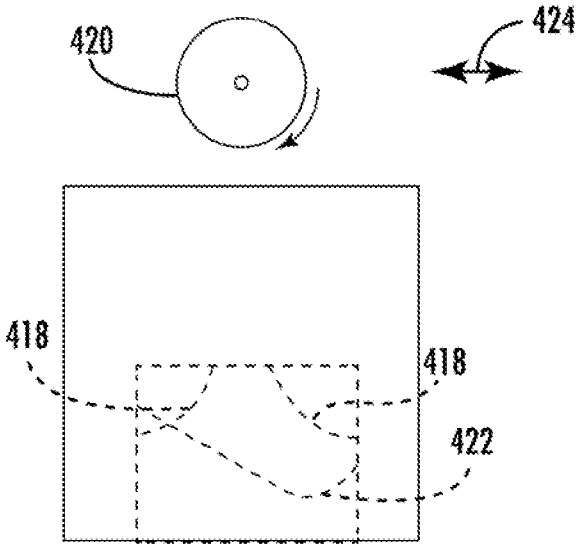
FIG. 4E is a side view illustrating fifth exemplary step gap configurations useful in, for example, the inductive device illustrated in FIGS. 2A-2C.

Referring now to FIG. 4E, a variation on the step gap created in FIG. 4D is illustrated. Specifically, the step gap 418 is created by plunging the dicing saw 420 at two distinct points along core thereby creating two step gap portions 418. In other words, an air gap remains in the portion above line 418, while the portion underneath line 418 has a magnetic permeability equal to the underlying core material (i.e., this portion is not gapped). In this manner, the underlying geometry and surface area for the air gap can be manipulated in order to achieve the desired inductive device characteristics for the core.

Moreover, while the embodiment illustrated in FIG. 4E illustrates an air gap created by two plunges of the dicing saw, it is appreciated that three or more plunges of the dicing saw can create air gaps having various desirable inductive parameters.

Additionally, it is appreciated that dicing saw 420 plunge depths that vary as a function of traversal (e.g., as shown by line 424) can also be readily implemented. These and other variations are presently contemplated by the inventors hereof.

Methods of Manufacture—

Figure 5:
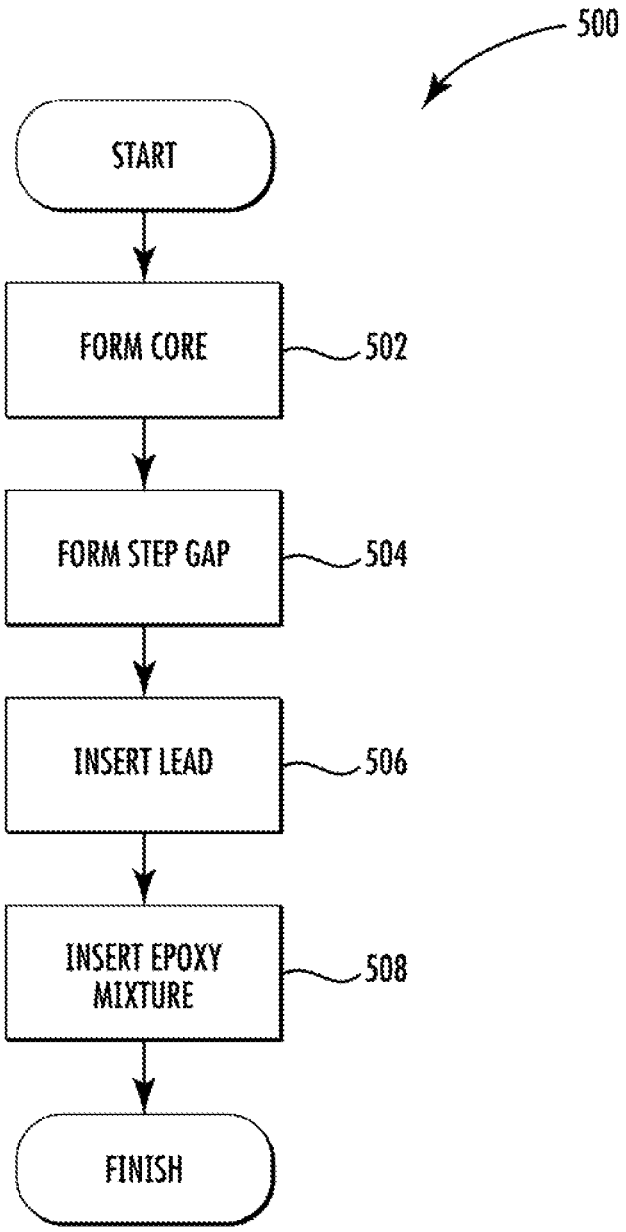
FIG. 5 is a logical flow diagram illustrating an exemplary embodiment of a method of manufacturing an inductive device in accordance with the principles of the present disclosure.

Referring now to FIG. 5, an exemplary embodiment of a method for manufacturing 500 an inductive device is described. At step 502, the core (such as the core illustrated in FIG. 1) is formed. As discussed previously herein, the core can be formed as a unitary piece with the geometry as shown in FIG. 1. Alternatively, the core can be formed as a solid rectangular block, and the geometry shown in FIG. 1 can be machined into this solid rectangular block. As yet another alternative, the core can be formed from multiple distinct sections that are subsequently joined together using, for example, an epoxy of the type well understood in the electronic arts. Combinations of the foregoing (as applicable) may also be utilized consistent with the disclosure.

At step 504, the step gap is formed into the core. In one embodiment, the step gap is formed via use of a dicing saw that traverses the width of the formed core. Alternative variants can utilize the methodology described with respect to FIGS. 4A-4E in order to produce these step gap variants, or yet other approaches that will be recognized by those of ordinary skill given the present disclosure.

At step 506, the lead for the inductive device is inserted into the core. Specifically, the lead is placed inside of the core cavity between the two end core elements. In one exemplary embodiment, the lead is inserted over the step gap formed in step 504.

At step 508, the epoxy mixture is disposed around the inserted lead and into the formed core. In one exemplary embodiment, the inserted lead prevents the epoxy mixture from entering the step gap, thereby leaving an air gap within the body of the inductive device.

Alternatively, various epoxy mixture formulations can be inserted into the step gap, the lead inserted, and then a subsequent epoxy mixture formulation can be disposed around the inserted lead and into the body of the formed core. The initial epoxy mixture and subsequent epoxy mixture can have the same magnetic properties, or alternatively may be made from differing ferrite and epoxy mixtures.

It will be recognized that while certain embodiments of the present disclosure are described in terms of a specific sequence of steps of a method, these descriptions are only illustrative of the broader methods described herein, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure and claimed herein.

While the above detailed description has shown, described, and pointed out novel features as applied to various embodiments, it will be understood that various omissions, substitutions, and changes in the form and details of the device or process illustrated may be made by those skilled in the art without departing from principles described herein. The foregoing description is of the best mode presently contemplated. This description is in no way meant to be limiting, but rather should be taken as illustrative of the general principles described herein. The scope of the disclosure should be determined with reference to the claims.

What is claimed is:

1. An inductive device comprising:

a core base element comprising:

two side core elements; and a center core element having a step gap formed therein, the center core element disposed between the two side core elements;

wherein relative sizes for the center core element and the two side core elements are selected so as to form a cavity between the two side core elements, the cavity comprising a U-shaped cavity;

a winding disposed at least partially within the cavity; and a mixture of magnetic powder and epoxy disposed within the cavity.

2. The inductive device of claim 1, wherein the step gap comprises at least a first width and a second width, the second width being different from the first width.

3. The inductive device of claim 1, wherein:

a height, a width and a thickness of the center core element is smaller in dimension than a corresponding height, width and thickness for either of the two side core elements; and the step gap receives the mixture of magnetic powder and epoxy.

4. The inductive device of claim 1, wherein a permeability of the mixture of magnetic powder and epoxy is in a range of approximately 60 to 200.

5. The inductive device of claim 1, wherein the step gap is configured to enable a higher inductance value for the inductive apparatus with no direct current (DC) bias applied as compared with a corresponding inductive device without a corresponding step gap.

6. The inductive device of claim 1, wherein the mixture of magnetic powder and epoxy and the winding substantially fills the U-shaped cavity such that generated magnetic fields resultant from a flow in current through the winding is substantially contained within the inductive device.

7. The inductive device of claim 6, wherein the winding comprises a single turn self-leaded winding.

8. The inductive device of claim 7, wherein the inductive device comprises a rectangular-shaped inductive device.

9. The inductive device of claim 8, wherein the step gap is configured to provide the inductive device with an initial inductance value at a low direct current (DC) bias current that is higher than an inductance value at an operational direct current (DC) bias current level.

10. The inductive device of claim 1, wherein the step gap is configured to provide the inductive device with a relatively high inductance value at relatively low direct current (DC) bias currents that flow through the winding.

11. The inductive device of claim 10, wherein the relatively high inductance value is greater than 200 nH at DC bias currents less than 10 A.

12. The inductive device of claim 11, wherein the step gap has a length on the order of 4.5 mm and a gap width on the order of 0.08 mm.

13. The inductive device of claim 1, wherein the two side core elements and the center core element having the step gap formed therein are collectively formed from a unitary piece of a magnetically permeable material.

14. The inductive device of claim 13, wherein the magnetically permeable material has a relative permeability in the range of 2000-5000.

15. A portable electronic device, comprising:

a switched mode power supply, the switched mode power supply including an inductive device having a step gap formed therein, the inductive device comprising:

a core base element comprising:

two side core elements; and a center core element having the step gap formed therein, the center core element disposed between the two side core elements;

wherein relative sizes for the center core element and the two side core elements are selected so as to form a U-shaped cavity between the two side core elements;

a winding disposed at least partially within the U-shaped cavity; and a magnetic epoxy disposed within the U-shaped cavity;

wherein the inductive device with the step gap formed therein is configured to increase an initial inductance value for the inductive device at lower current values as compared with an inductance value for the inductive device at a higher operational current.

16. The portable electronic device of claim 15, wherein the magnetic epoxy is configured to mitigate a fringing magnetic field when current is applied to the inductive device.

17. The portable electronic device of claim 16, wherein the winding comprises one or more leads configured to couple to an external substrate.

18. The portable electronic device of claim 17, wherein the two side core elements and the center core element are collectively formed from a unitary piece of a magnetically permeable material.

* * * * *